US009896173B2

(12) United States Patent
Baros et al.

(10) Patent No.: US 9,896,173 B2
(45) Date of Patent: Feb. 20, 2018

(54) ADJUSTABLE JACK PLATE AND TRIM AND TILT SYSTEM FOR A MARINE VESSEL

(71) Applicant: Marine Canada Acquisition Inc., Richmond (CA)

(72) Inventors: Davor Baros, Vancouver (CA); Richard D. Pierce, Mountain Home, AR (US); Eric B. Fetchko, Burnaby (CA)

(73) Assignee: Marine Canada Acquisition Inc. (CA)

( * ) Notice: Subject to any disclaimer, the term of this patent is extended or adjusted under 35 U.S.C. 154(b) by 0 days.

(21) Appl. No.: 15/264,741

(22) Filed: Sep. 14, 2016

(65) Prior Publication Data

US 2017/0073054 A1 Mar. 16, 2017

Related U.S. Application Data

(60) Provisional application No. 62/218,027, filed on Sep. 14, 2015, provisional application No. 62/306,913, filed on Mar. 11, 2016.

(51) Int. Cl.

| | |
|---|---|
| ***F16M 1/00*** | (2006.01) |
| ***B63H 20/06*** | (2006.01) |
| ***B63H 20/10*** | (2006.01) |

(52) U.S. Cl.

CPC ..... *B63H 20/06* (2013.01); *B63H 20/10* (2013.01)

(58) Field of Classification Search

None

See application file for complete search history.

(56) References Cited

U.S. PATENT DOCUMENTS

| | | | | |
|---|---|---|---|---|
| 5,484,311 | A | 1/1996 | Detwiler et al. | |
| 5,964,627 | A | 10/1999 | Detwiler | |
| 6,305,996 | B1 | 10/2001 | Detwiler | |
| 7,092,590 | B2 * | 8/2006 | Lim | G02B 6/105 385/15 |
| 7,469,437 | B2 * | 12/2008 | Mikkelsen | A47C 7/022 5/655.9 |
| 8,025,964 | B2 * | 9/2011 | Landvik | A47C 27/15 428/213 |
| 2007/0221113 | A1 | 9/2007 | Detwiler et al. | |

* cited by examiner

*Primary Examiner* — Amy Sterling
(74) *Attorney, Agent, or Firm* — Berenato & White, LLC

(57) ABSTRACT

An apparatus for adjusting positions of an outboard propulsion unit of a marine vessel comprises a jack plate having a jack plate actuator capable of moving the propulsion unit between raised and lowered positions and a swivel bracket having a swivel bracket actuator capable of pivoting the propulsion unit between raised and lowered trim positions. There is a control system operatively connected to the jack plate actuator and the swivel bracket actuator. The control system includes a first manual control which incrementally moves the jack plate an incremental amount each time the first manual control is actuated and a second manual control which incrementally pivots the swivel bracket an incremental amount each time the second manual control is actuated. Movement of the propulsion unit within a tilt range may be detected and the jack plate may be moved to a preset position.

5 Claims, 19 Drawing Sheets

ADJUSTABLE JACK PLATE AND TRIM AND TILT SYSTEM FOR A MARINE VESSEL

CROSS-REFERENCE TO RELATED APPLICATIONS AND CLAIM TO PRIORITY

This application claims the benefit of provisional application No. 62/218,027 filed on Sep. 14, 2015 and of No. 62/306,913 filed on Mar. 11, 2016, which are hereby incorporated herein by reference in their entirety and to which priority is claimed

FIELD OF THE INVENTION

The present invention relates to an adjustable jack plate and a trim and tilt system for a marine vessel having an outboard steering system.

BACKGROUND OF THE INVENTION

In conventional outboard steering systems for marine vessels, the propulsion units are mounted low enough on the marine vessel so as not to cause cavitation while operating in choppy waters or while executing turns. The propulsion units may be mounted higher when the marine vessel is operating on a straight course in calm waters. However, outboard propulsion units are conventionally bolted to the transom of the marine vessel which prevents movement of the propulsion units readily up or down. The propulsion units may also be trimmed upwardly to run in shallow water to avoid contacting the bottom or weeds. However, trimming a propulsion unit upwardly may place the cavitation plate in front of the propeller, thereby encouraging cavitation. Furthermore, an upwardly trimmed propulsion unit may cause a spray of water to shoot up into the air, which is indicative of a waste of energy. Additionally, an upwardly trimmed propulsion unit may cause a downward thrust on the marine vessel which pushes the marine vessel down, particularly at the stern. This may raise the bow and lower the stern of the marine vessel, making the draft of the marine vessel deeper.

In contrast, raising a propulsion unit vertically keeps the cavitation plate above the propeller and aligned with the movement of the marine vessel. Jack plates have accordingly been developed to allow outboard propulsion units to be raised vertically while running in shallow water to avoid the negative consequences of trimming propulsion units. Typically the propulsion units are positioned so as to be just on the verge of cavitation which allows the marine vessel to run and start up in far shallower depths. However, one of the concerns commonly encountered with the use of jack plates is for an operator to know the precise height of the propulsion unit. Typically the jack plate is adjusted manually and the operator may use a gauge as a visual indicator of the height of the propulsion unit. There is however a risk of positioning the propulsion unit too high to make a safe turn. The propulsion unit may also be raised so the cooling water intake is raised above the surface of the water, risking overheating of the propulsion unit. Most operators typically therefore compromise toward safety and use a manual jack plate at a safer, lower level which forfeits some of the potential speed gains.

Another issue with the use of jack plates is that the propulsion unit is positioned more outwardly relative to the marine vessel since the propulsion unit is connected to the transom via the jack plate. This may cause the propulsion unit to no longer clear the top of the transom when fully tilted out of the water. Consequently, when the jack plate is fully lowered, the propulsion unit or the steering cylinder may collide with the transom or the jack plate, possibly causing damage to the propulsion unit or the steering cylinder. This is a major safety concern.

There is accordingly a need for an improved jack plate and controls therefor which permit the jack plate to be adjusted readily while the marine vessel is in operation and, at the same time, provide an operator with reliable feedback as to the position of the jack plate without requiring the height of the propulsion unit to be measured or requiring the operator to visually refer to a gauge, which may be difficult while operating the marine vessel.

SUMMARY OF THE INVENTION

It is an object of the present invention to provide an improved jack plate and controls therefor which overcome the above disadvantages.

There is accordingly provided an apparatus for adjusting a position of an outboard propulsion unit of a marine vessel. The apparatus comprises a jack plate which has a mount for the outboard propulsion unit and which is mountable on a transom of the marine vessel. The jack plate has a jack plate actuator capable of raising the propulsion unit to a raised position and lowering the propulsion unit to a lowered position. The apparatus also includes a control system operatively connected to the jack plate actuator for controlling movement between the raised position and the lowered position. The control system includes a first manual control which incrementally moves the jack plate an incremental amount each time the first manual control is actuated. The control system also includes a memory which stores the number of times the first manual control has been actuated and moves the jack plate a plurality of incremental amounts equivalent to the number of times the first manual control has been actuated.

The apparatus may comprise a plurality of jack plates and each jack plate may have a mount for a corresponding one of a plurality of outboard propulsion units. The first manual control may cause the jack plates to move upwardly or downwardly synchronously, whereby a plurality of the propulsion units move the same amount when the first manual control is actuated.

The apparatus may further include a swivel bracket having a mount for the outboard propulsion unit. The swivel bracket may be connected to the jack plate. The swivel bracket may have a swivel bracket actuator capable of pivoting the propulsion unit upwardly to a raised trim position and pivoting the propulsion unit downwardly to a lowered trim position. The control system may include a second manual control which incrementally pivots the swivel bracket an incremental amount each time the second manual control is actuated. The memory of the control system may store the number of times the second manual control has been actuated and may pivot the swivel bracket a plurality of incremental amounts equivalent to the number of times the second manual control has been actuated.

The apparatus may comprise a plurality of swivel brackets and each swivel bracket may have a mount for a corresponding one of a plurality of outboard propulsion units. The second manual control may cause the swivel brackets to move upwardly or downwardly synchronously, whereby a plurality of said propulsion units pivot the same amount when the second manual control is actuated.

There is also provided a method of controlling movement upwardly and downwardly of an outboard propulsion unit mounted on a marine vessel via a jack plate powered by an actuator. The method comprises operating a manual control in a pulse-like manner and moving the jack plate and the propulsion unit an incremental amount for each operation of the manual control in the pulse-like manner.

The manual control may be operated a plurality of times in the pulse-like manner in rapid succession. The plurality of times in which the manual control is operated in the pulse-like manner in rapid succession may be stored in memory. The jack plate may be moved a plurality of incremental amounts corresponding to the plurality of times in which the manual control is operated in the pulse-like manner in rapid succession. The jack plate may be moved the plurality of incremental amounts continuously without delay between each operation of the manual control in the pulse-like manner in rapid succession. A position of the jack plate may be stored in memory and the jack plate may be moved to the stored position. Movement of the propulsion unit within a tilt range may be detected and the jack plate may be moved to a preset position.

There may be a plurality of outboard propulsion units and each propulsion unit may be mounted on the marine vessel via a corresponding one of a plurality of jack plates. Each jack plate may be powered by an actuator. The jack plates and the propulsion units may be moved synchronously and the same amount for each operation of the manual control.

There is further provided a method of controlling upwardly and downwardly pivoting of an outboard propulsion unit mounted on a marine vessel via a swivel bracket powered by an actuator. The method comprises operating a manual control in a pulse-like manner and pivoting the swivel bracket and the propulsion unit an incremental amount for each operation of the manual control in the pulse-like manner.

The manual control may be operated a plurality of times in the pulse-like manner in rapid succession. The plurality of times in which the manual control is operated in the pulse-like manner in rapid succession may be stored in memory. The swivel bracket may be pivoted a plurality of incremental amounts corresponding to the plurality of times in which the manual control is operated in the pulse-like manner in rapid succession. The swivel bracket may be pivoted the plurality of incremental amounts continuously without delay between each operation of the manual control in the pulse-like manner in rapid succession. A position of the swivel bracket may be stored in memory and the swivel bracket may be pivoted to the stored position.

There may be a plurality of outboard propulsion units and each propulsion unit may be mounted on the marine vessel via a corresponding one of a plurality of swivel brackets. Each swivel bracket may be powered by an actuator. The swivel brackets and the propulsion units may be moved synchronously and the same amount for each operation of the manual control.

BRIEF DESCRIPTION OF THE DRAWINGS

The invention will be more readily understood from the following description of the embodiments thereof given, by way of example only, with reference to the accompanying drawings, in which.

DESCRIPTION OF SPECIFIC EMBODIMENTS

Figure 1:
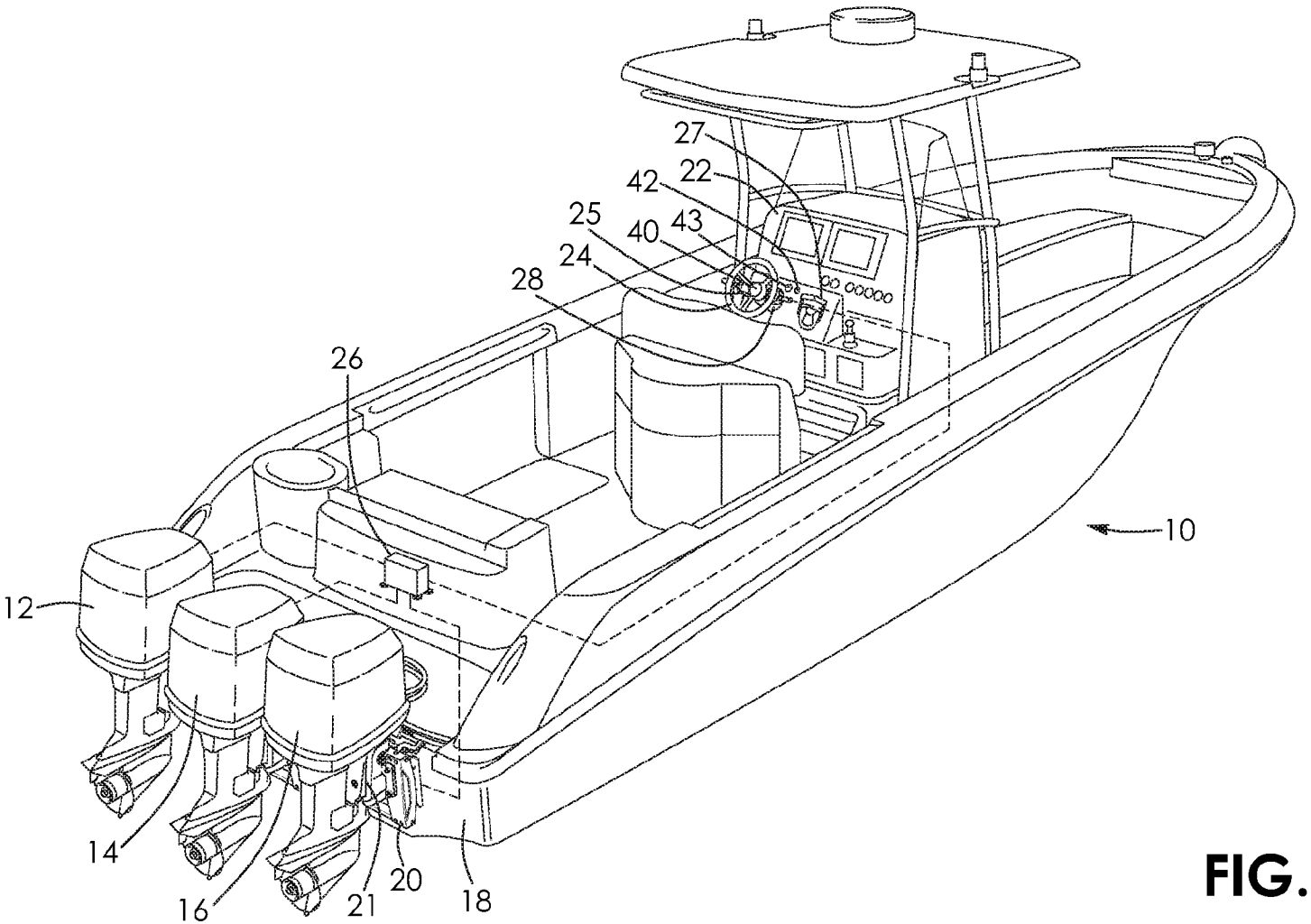
FIG. 1 is a perspective view of a marine vessel provided with a plurality of outboard propulsion units equipped with jack plates and swivel brackets.

Referring to the drawings and first to FIG. 1, there is shown a marine vessel 10 which is provided with a plurality of propulsion units in the form of three outboard engines 12, 14 and 16. The outboard engines 12, 14 and 16 are mounted on a transom 18 of the marine vessel 10 via respective jack plates, for example, jack plate 20 as shown for the outboard engine 16. The outboard engines 12, 14 and 16 are connected to their respective jack plates by corresponding swivel brackets, for example, swivel bracket 21 as shown for the outboard engine 16. The marine vessel 10 is also provided with a control station 22 that supports a steering wheel 24 and an input device 25 mounted on a helm 28. The steering wheel 24 is conventional and steers the outboard engines 12, 14 and 16. The input device 25 is in communication with a controller 26 and allows an operator to raise or lower the outboard engines 12, 14 and 16 while the marine vessel 10 is in operation as discussed in detail below. The input device 25 also allows the operator to trim and tilt the outboard engines 12, 14 and 16 while the marine vessel 10 is in operation as discussed in detail below.

Figure 2:
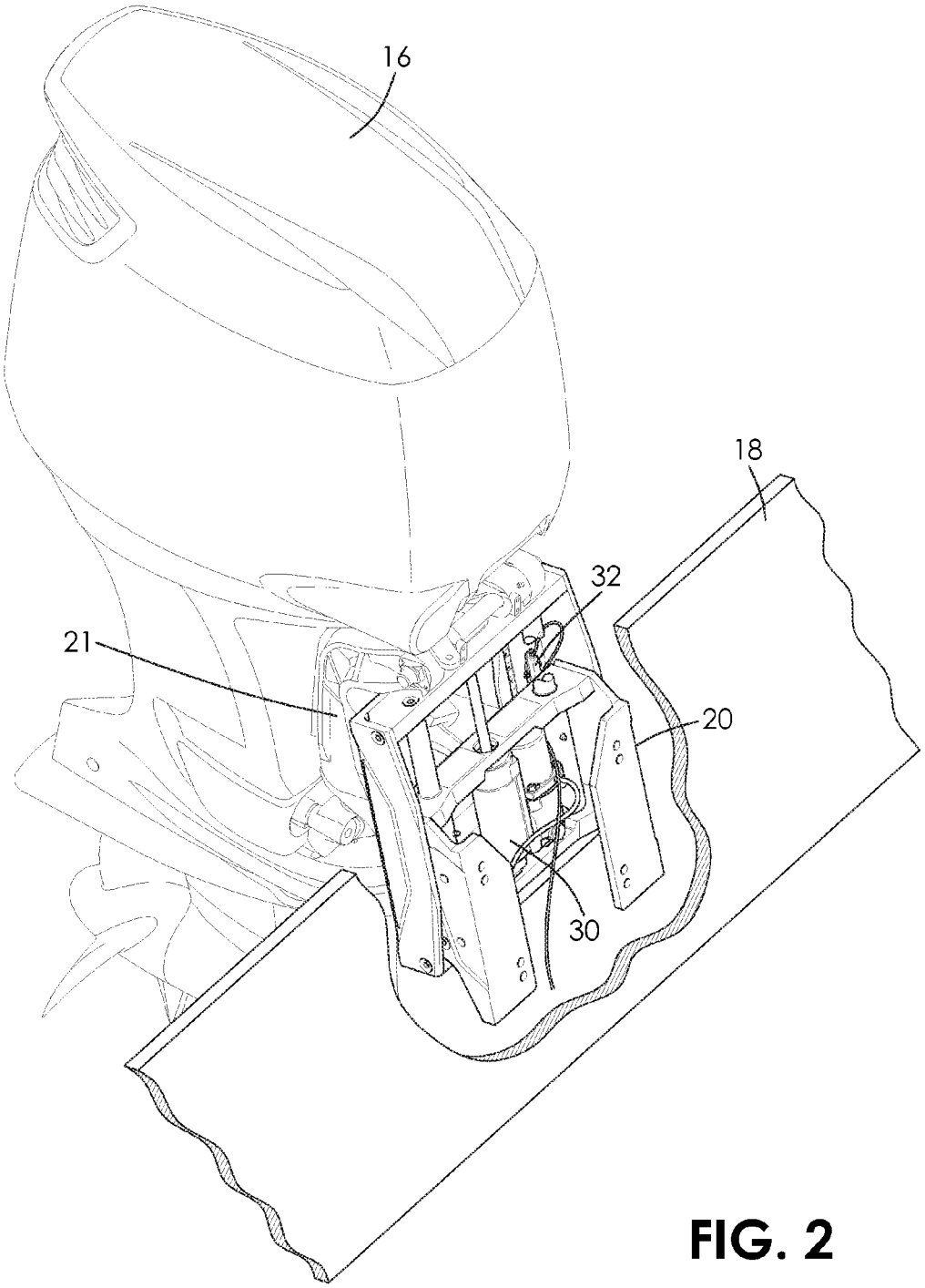
FIG. 2 is a perspective, fragmentary view showing one of the propulsion units mounted to a transom of the marine vessel of FIG. 1 via a jack plate, the propulsion unit being connected to the jack plate by a swivel bracket, the transom being partly broken away.

Referring now to FIG. 2, the jack plate 20 and the swivel bracket 21 for the outboard engine 16 are shown in greater detail. The jack plates and the swivel brackets for the outboard engines 12 and 14 are substantially the same in structure and function as the jack plate 20 and the swivel bracket 21 for the outboard engine 16. Accordingly, only the jack plate 20 and the swivel bracket 21 are described in detail herein with the understanding that the other jack plates and swivel brackets have substantially the same structure and function in substantially the same manner. The jack plate 20 has an actuator which in this example is a hydraulic actuator 30. The hydraulic actuator 30 operates to raise or lower the outboard engine 16 relative to the transom 18 of the marine vessel 10. The hydraulic actuator 30 is shown in greater detail in FIG. 4. The jack plate 20 also has a position sensor 32, shown in FIG. 2, which indicates the degree to which the jack plate is raised or lowered. The position sensor 32 is shown in greater detail in FIG. 4. A suitable sensor is sold by SeaStar Solutions under the trademark SmartStick. However, other types of sensors could be substituted. Typically the outboard engines 12, 14 and 16 are raised for operation in shallower water and lowered for operation in deeper water. The swivel bracket 21 supports the outboard engine 16 and functions to pivot the outboard engine 16 relative to the transom 18 of the marine vessel 10.

Figure 1A:
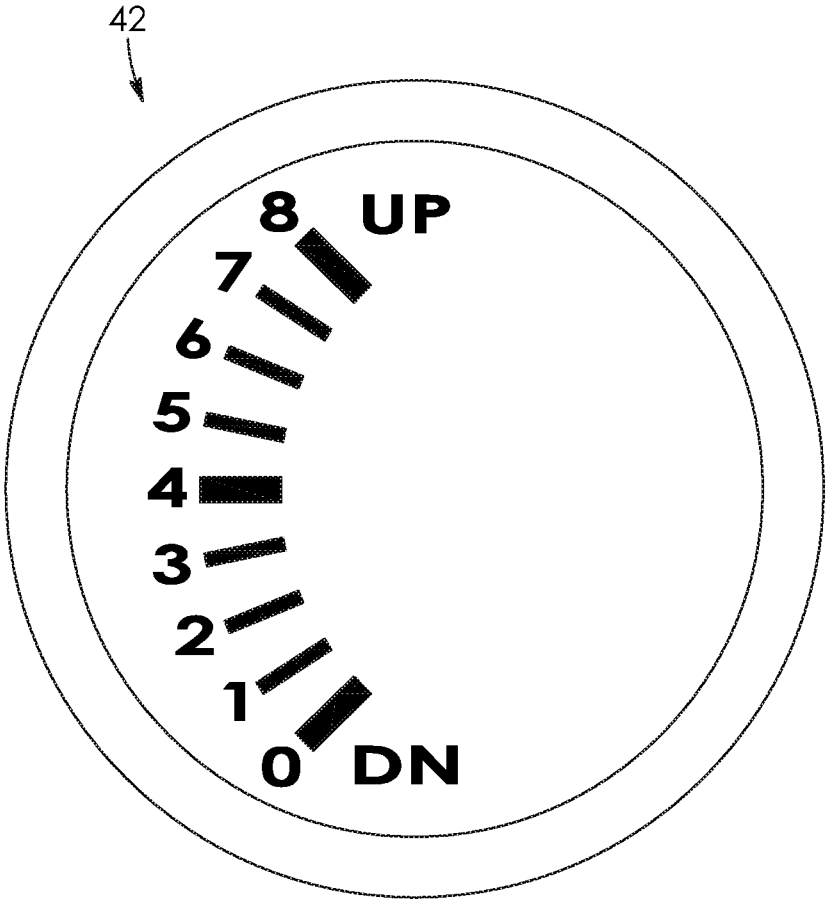
FIG. 1A is a front elevation view of a face of a gauge of the marine vessel of FIG. 1.
Figure 3:
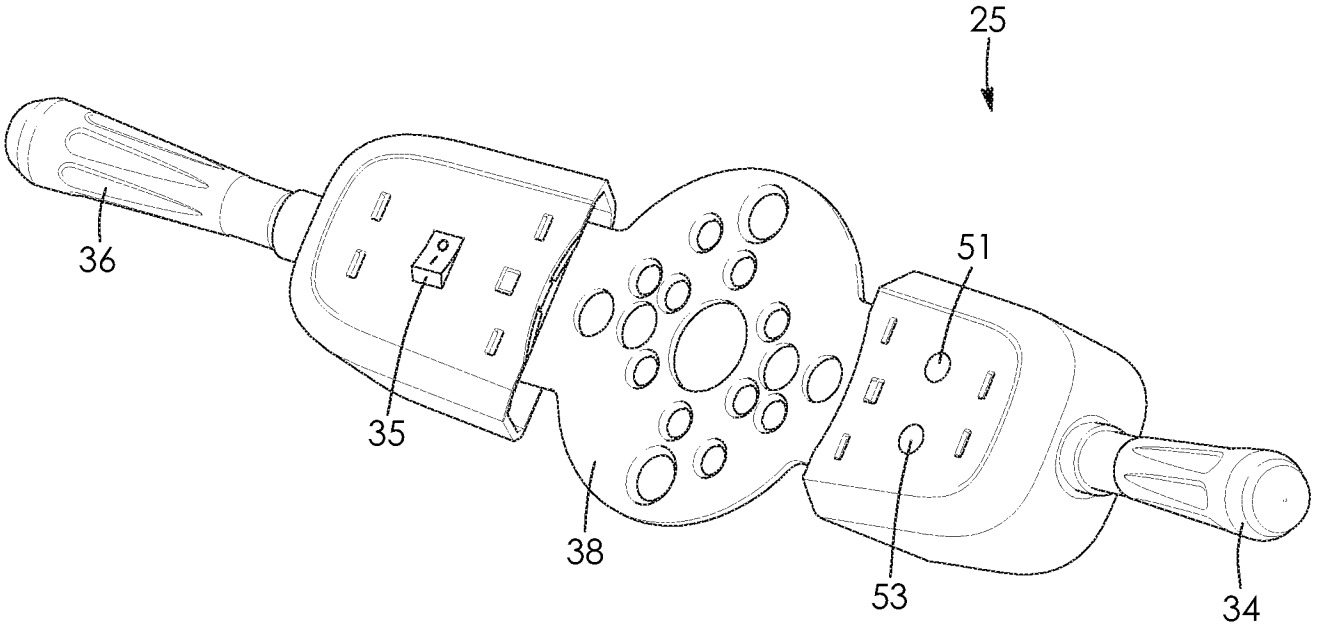
FIG. 3 is a perspective view of an input device of the marine vessel of FIG. 1.

Referring now to FIG. 3, the input device 25 is shown in greater detail and includes manual controls in the form of incremental or toggle switches 34 and 36 which are located on a mount 38. The mount 38 may be fitted to a steering column 40 of the marine vessel 10 shown in FIG. 1. The toggle switches 34 and 36 may be, for example, Pro Trim™ switches although alternative types of switches or controls may be substituted. The toggle switches 34 and 36 allow the operator to adjust the position of the outboard engines 12, 14 and 16. The controller 26 receives input from the operator via the toggle switches 34 and 36 and moves the jack plates and the swivel brackets accordingly. For example, the toggle switch 34 may be used to raise or lower the outboard engine 16 via the jack plate 20. The vertical position of the outboard engine 16 is visually indicated to the operator by a gauge 42 on the control station 22 which is shown in FIG. 1. The face of the gauge 42 is shown in greater detail in FIG. 1A. The toggle switch 34 is moved upwardly to move the outboard engine 16 upwards and the toggle switch 34 is moved downwardly to move the outboard engine 16 downwards. The toggle switch 34 is released when a desired vertical position of the outboard engine 16 is achieved as seen by the gauge 42 shown in FIGS. 1 and 1A. The toggle switch 34 may be spring-biased to return to a central position after being released. The controller 26 has an output to the gauge 42 which accordingly shows the vertical position of the jack plate 20 and the outboard engine 16.

Similarly, in this example, the toggle switch 36 may be used to pivot the outboard engine 16 via the swivel bracket 21. The trim position of the outboard engine 16 is visually indicated to the operator by a gauge 43 on the control station 22 which is shown in FIG. 1. The toggle switch 36 is moved upwardly to pivot the outboard engine 16 upwards and the toggle switch 36 is moved downwardly to pivot the outboard engine 16 downwards. The toggle switch 36 is released when a desired trim position of the outboard engine 16 is achieved as seen by the gauge 43. The toggle switch 36 may be spring-biased to return to a central position after being released. The controller 26 has an output to the gauge 43 which accordingly shows the trim position of the swivel bracket 21 and the outboard engine 16.

The toggle switches 34 and 36 may be used to operate the jack plate 20 and the swivel bracket 21, respectively, in a standard or "normal" mode as described above. However, the toggle switches 34 and 36 may also be used to operate the jack plate 20 and the swivel bracket 21, respectively, in a "smart" mode and to move the jack plate 20 and the swivel bracket 21 to preset positions stored in the memory of the controller 26. The operation of the toggle switches 34 and 36 may be alternated between the normal mode and the smart mode by actuating a switch which in this example is a rocker switch 35 shown in FIG. 3. The rocker switch 35 is disposed adjacent the toggle switch 34 in this example but may be positioned in other locations.

Figure 5:
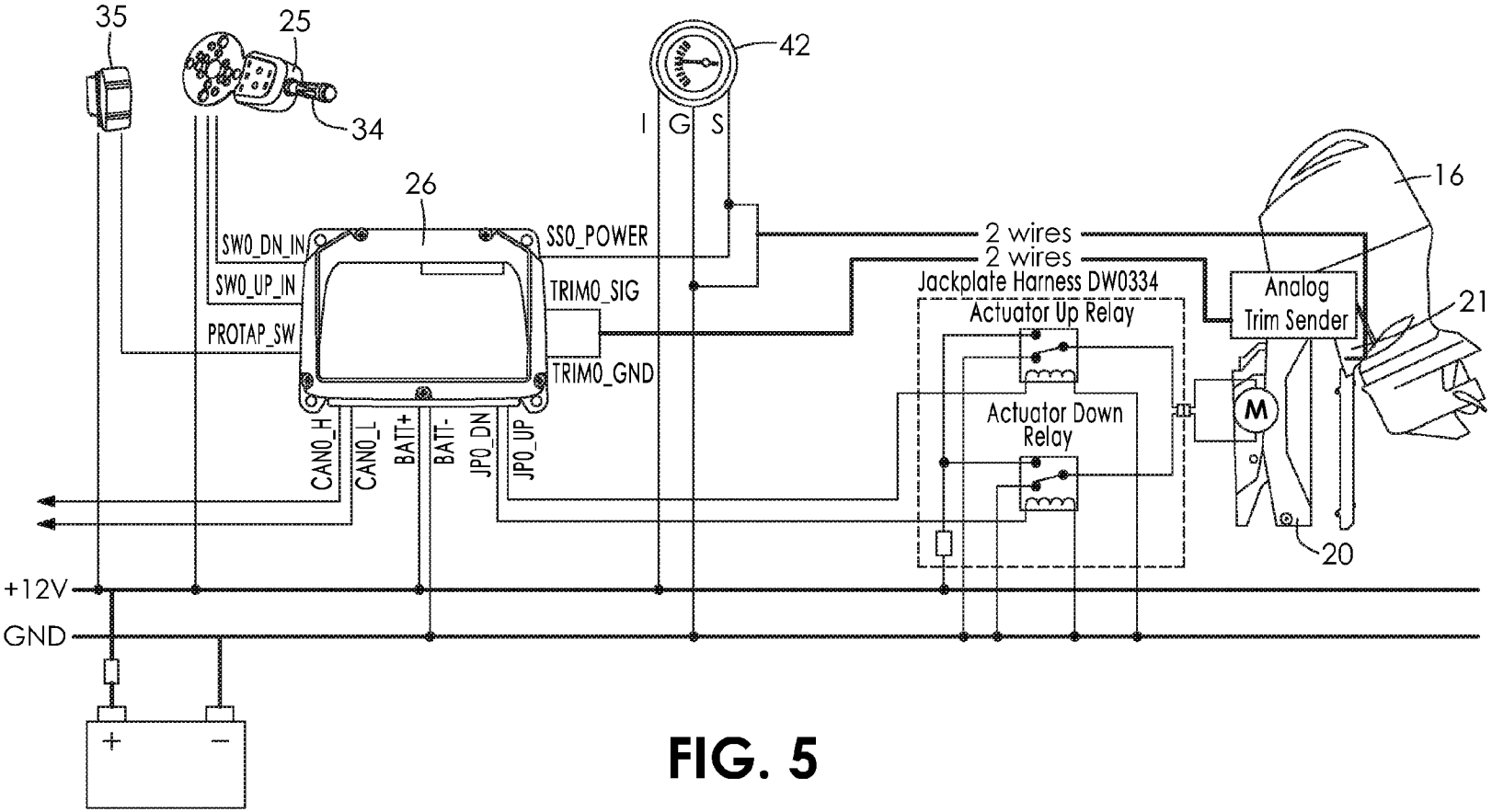
FIG. 5 is a schematic diagram of a control system for controlling movement of the jack plate.
Figure 6:
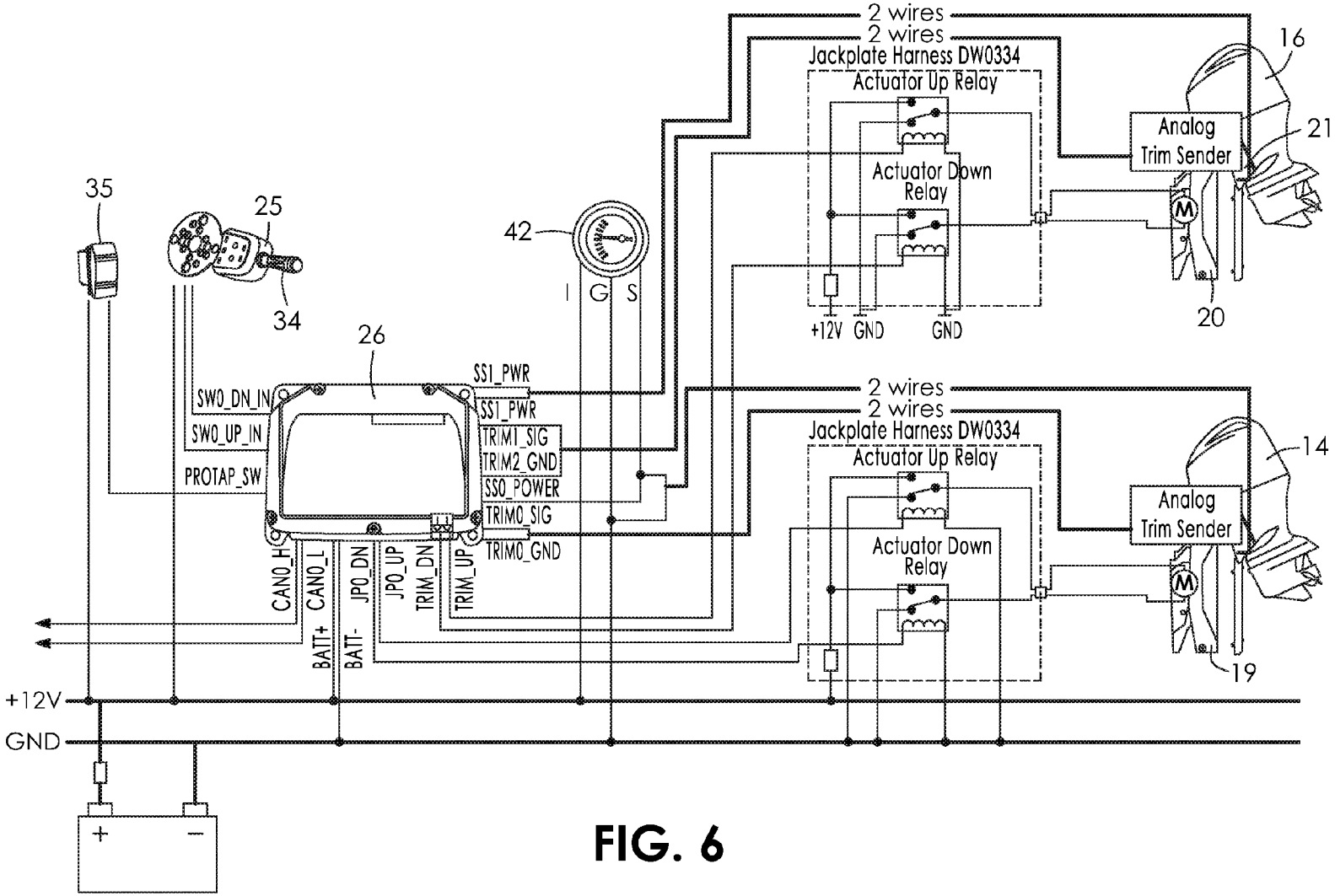
FIG. 6 is a schematic diagram of a control system for controlling movement of two jack plates.
Figure 7:
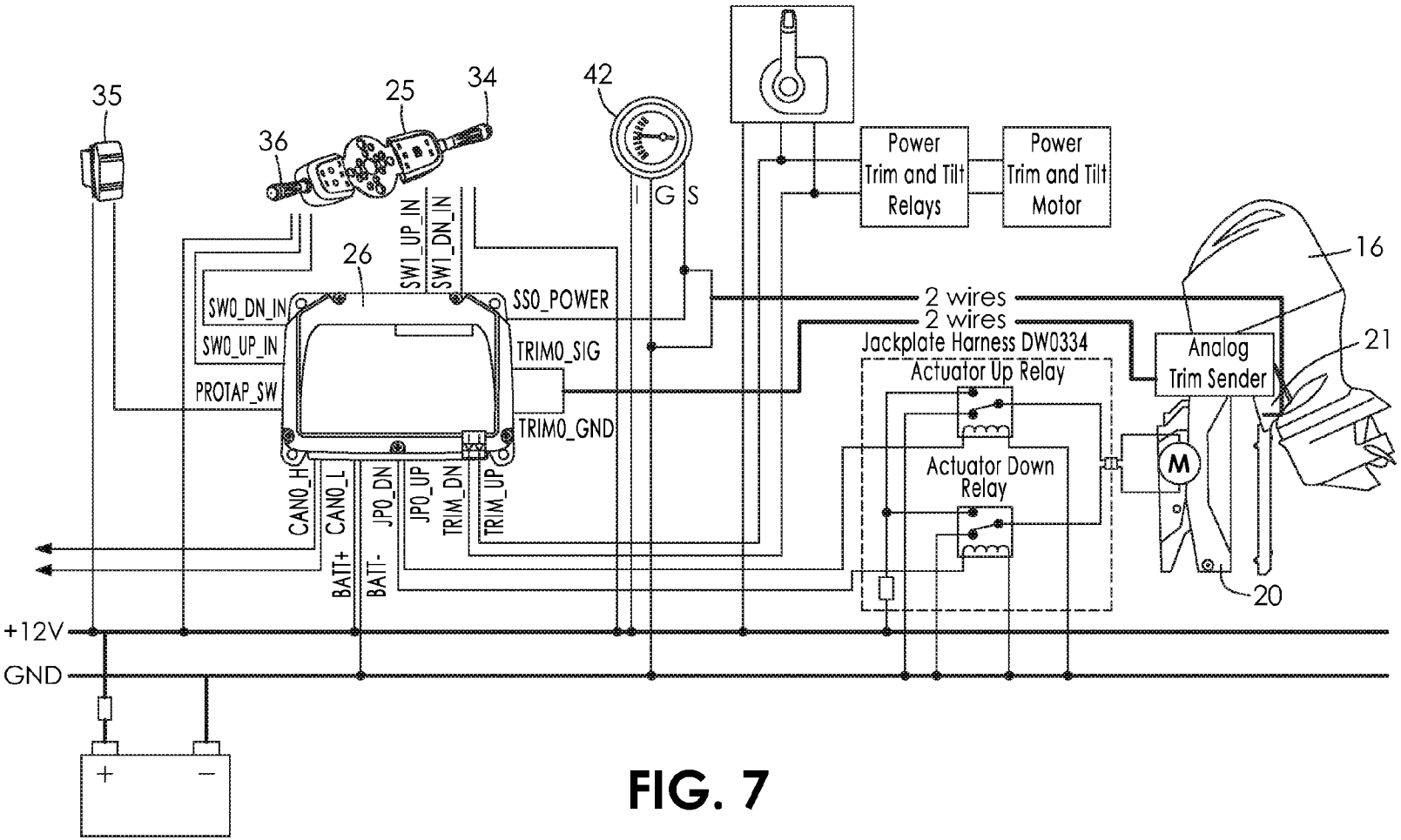
FIG. 7 is a schematic diagram of a control system for controlling movement of the jack plate and pivoting of the swivel bracket.

FIGS. 5 to 7 show operation of the jack plate 20 and the swivel bracket 21 in the normal and smart modes. In this example, the position sensor 32, shown in FIG. 2, is powered by the gauge 42. When the rocker switch 35 is in the OFF position, the control system operates in the normal mode. Inputs via the input device 25 are fed through to external relays. Control of the jack plate 20 and the swivel bracket 21 is open-loop in the normal mode, i.e. the jack plate 20 and the swivel bracket 21 are operated as if the controller 26 is not present. When the rocker switch 35 is in the ON position, the control system operates in the smart mode. Control of the jack plate 20 is closed-loop while control of the swivel bracket 21 remains open-loop. Control of the swivel bracket 21 is only closed-loop when there are switch inputs from the controller 26.

Input from a trim sender is required for controlling the swivel bracket 21 as shown in FIG. 7. However, input from a trim sender is optional when only controlling the jack plate 20 as shown in FIG. 5. In this example, the input device 25 may have a single toggle switch 34 instead of dual toggle switches 34 and 36 as shown in FIG. 7. FIG. 6 shows two jack plates connected to the controller 26, for example, jack plates 19 and 20 of the propulsion units 14 and 16, respectively.

Figure 8:
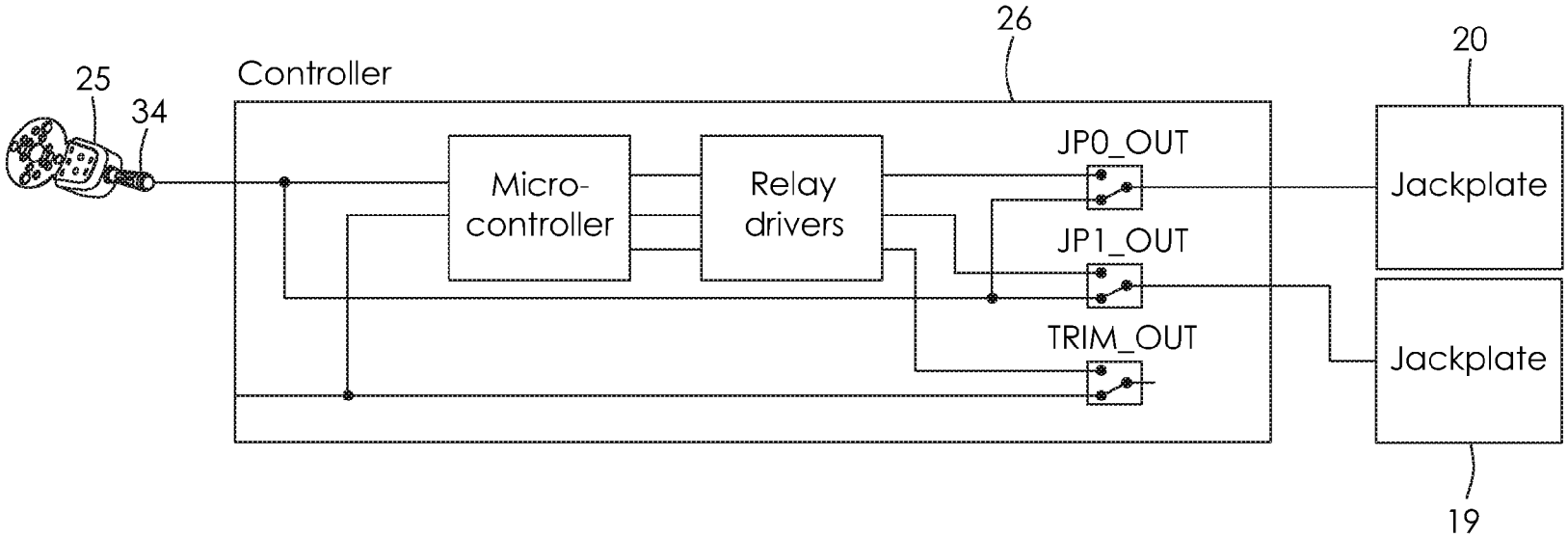
FIG. 8 is a schematic diagram of the control system of FIG. 6 operating in a normal mode.
Figure 9:
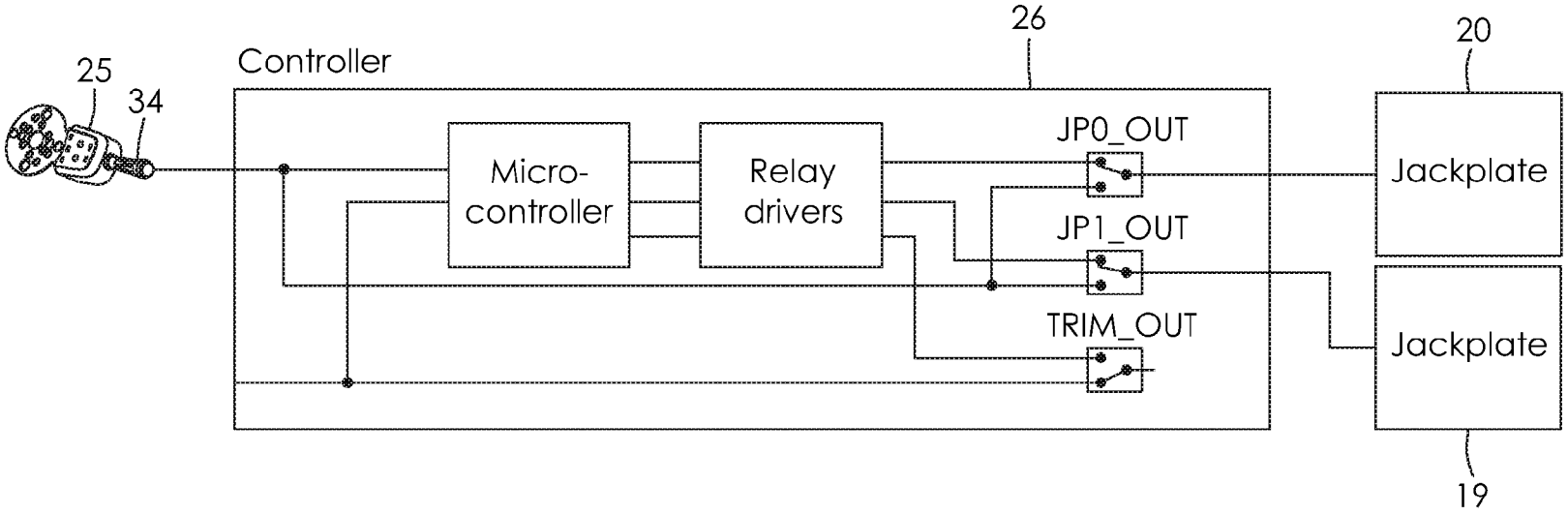
FIG. 9 is a schematic diagram of the control system of FIG. 6 operating in a smart mode.

FIG. 8 shows operation of the control system in the normal mode with two jack plates 19 and 20 connected to the controller 26. The control system operates in the normal mode when the rocker switch 35, shown in FIGS. 5 to 7, is in the OFF position or when the controller 26 is in an error state. Output of the controller 26 in the normal mode is the same as inputs via the toggle switch 34 of the input device 25. FIG. 9 shows operation of the control system in the smart mode with two jack plates 19 and 20 connected to the controller 26. The control system operates in the smart mode when the rocker switch 35 is in the ON position with no faults active. Output of the controller 26 to the jack plates 19 and 20 in the smart mode is from the relay drivers.

Figure 10:
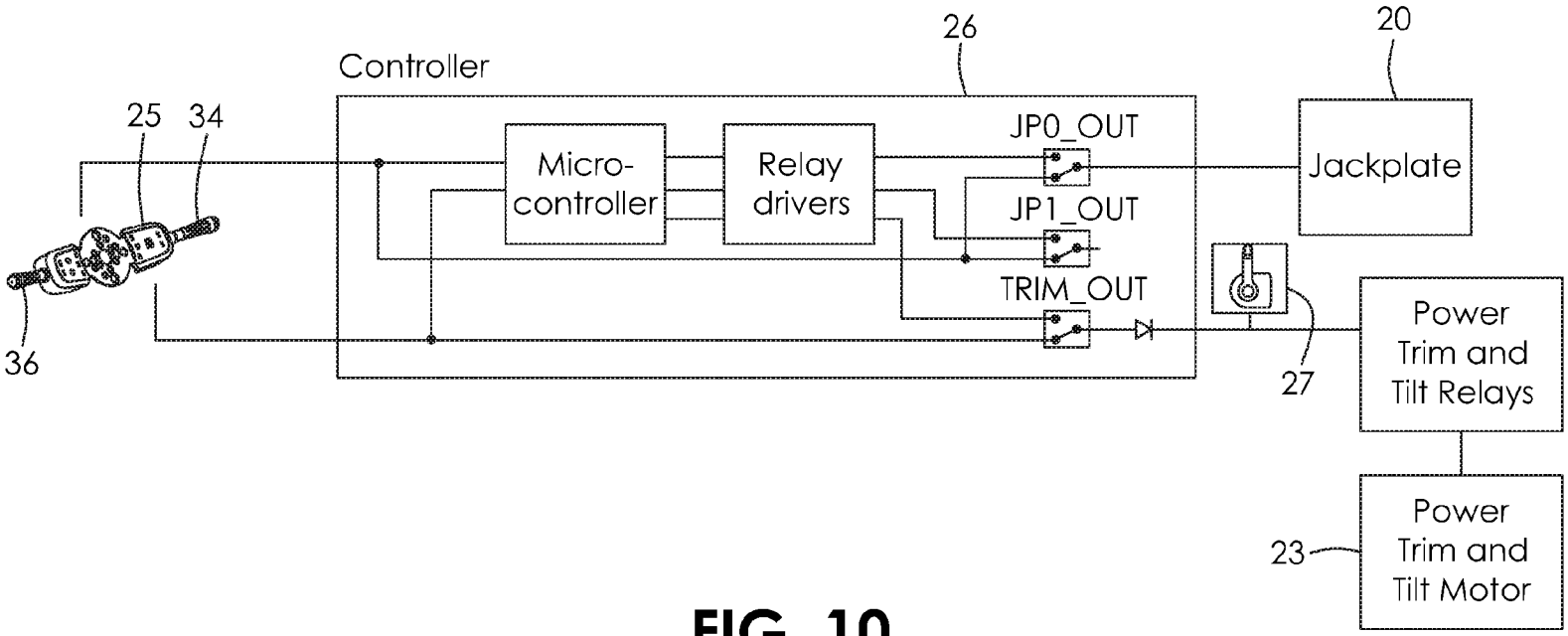
FIG. 10 is a schematic diagram of the control system of FIG. 7 operating in a normal mode.
Figure 11:
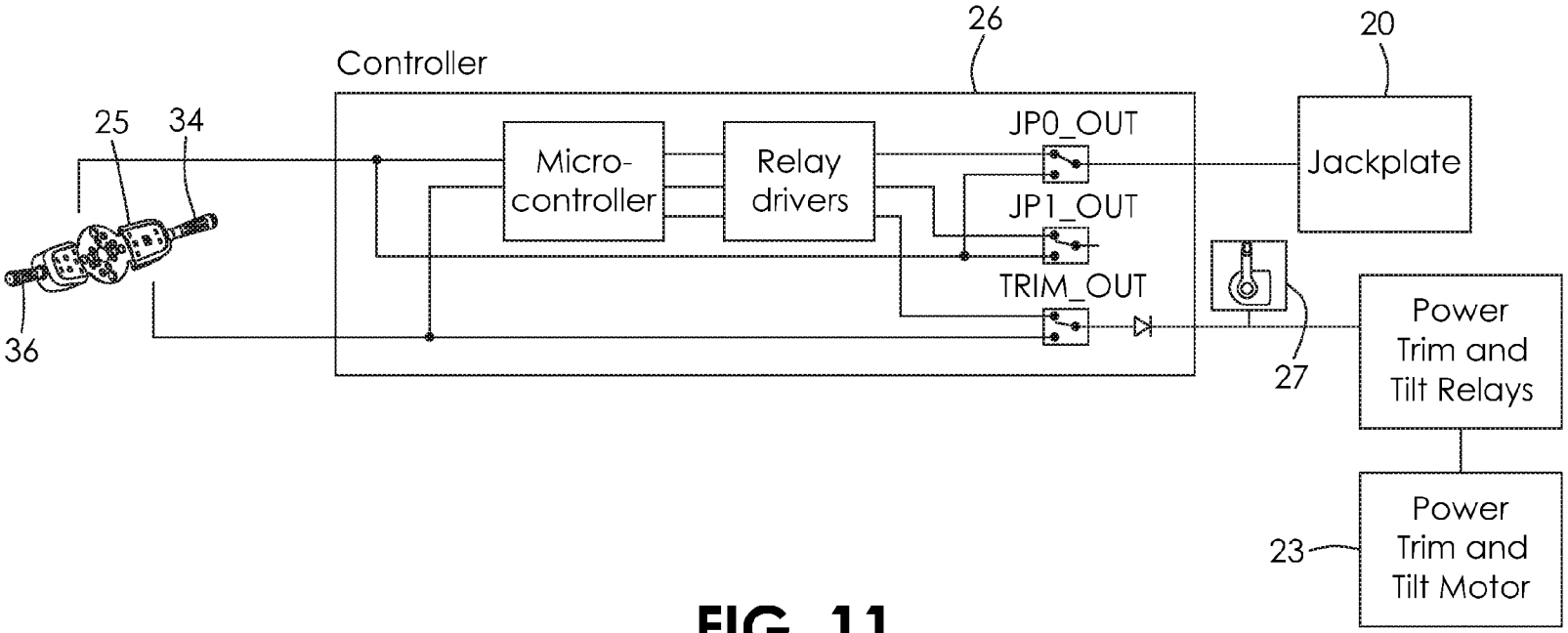
FIG. 11 is a schematic diagram of the control system of FIG. 7 operating in a smart mode.

FIG. 10 shows operation of the control system in the normal mode with one jack plate 20 and a power trim and tilt motor 23 connected to the controller 26. The control system operates in the normal mode when the rocker switch 35, shown in FIGS. 5 to 7, is in the OFF position or when the controller 26 is in an error state. Output of the controller 26 in the normal mode is the same as inputs via the toggle switches 34 and 36 of the input device 25. FIG. 11 shows operation of the control system in the smart mode with two jack plates 19 and 20 connected to the controller 26. The control system operates in the smart mode when the rocker switch 35 is in the ON position with no faults active. Output of the controller 26 to the jack plate 20 in the smart mode is from the relay drivers. Output of the controller 26 to the power trim and tilt motor 23 in the smart mode is also from the relay drivers.

The smart mode is designed for quick operation when the operator of the marine vessel 10 is preoccupied with other tasks such as fishing. The operator simply pushes or bumps the toggle switch 34 quickly up or down to move the jack plate 20 incrementally up or down along with the outboard engine 16. In this particular example, each bump of the toggle switch 34 moves the jack plate 20 upwardly or downwardly ¼ inch although this may vary in alternative embodiments. The number of bumps given to the toggle switch 34 is stored in the memory of the controller 26 and the controller 26 moves the jack plate 20 and the outboard engine 16 to the desired vertical position without the operator having to wait after the toggle switch 34 is pushed each time before actuating the toggle switch 34 again.

For example, the operator may wish to move the outboard engine 16 ¾ inches upwardly. This is achieved by pushing or bumping the toggle switch 34 upwardly three times in rapid succession. This may be accomplished quickly without waiting for the jack plate 20 to move each time. The operator knows the exact distance the outboard engine 16 will move without needing to refer to the gauge 42 which may be inconvenient if the operator is engaged in other tasks. In addition, as mentioned above, the controller 26 may be used to move the jack plate 20 to preset positions stored in memory. One memory position may be achieved, for example, by holding the toggle switch 34 upwardly for one to five seconds. Another position may be achieved, for example, by holding the toggle switch 34 downwardly for one to five seconds. In this example, there are two memory presets for the jack plate 20 but there may be different numbers of memory presets in other examples.

For example, there may be four memory presets for the jack plate 20. The toggle switch 34 may be pushed or bumped downwardly once to move the jack plate 20 to its lowest vertical position stored in memory. The toggle switch 34 may be pushed or bumped downwardly twice to move the jack plate 20 to a position which is two inches above its lowest vertical position. The toggle switch 34 may be pushed or bumped upwardly twice to move the jack plate 20 to a position which is four inches above its lowest vertical position. The toggle switch 34 may be pushed or bumped upwardly once to move the jack plate 20 to its highest vertical position stored in memory.

The operator pushes or bumps the toggle switch 36 quickly up or down to pivot the swivel bracket 21 incrementally up or down along with the outboard engine 16. In this particular example, each bump of the toggle switch 36 pivots the swivel bracket 21 upwardly or downwardly by one degree although this may vary in alternative embodiments. The number of bumps given to the toggle switch 36 is stored in the memory of the controller 26 and the controller 26 pivots the swivel bracket 21 and the outboard engine 16 to the desired trim position without the operator having to wait after the toggle switch 36 is pushed each time before actuating the toggle switch 36 again.

For example, the operator may wish to pivot the outboard engine 16 three degrees upwardly. This is achieved by pushing or bumping the toggle switch 36 upwardly three times in rapid succession. This may be accomplished quickly without waiting for the swivel bracket 21 to pivot each time. The operator knows the exact distance the outboard engine 16 will pivot without needing to refer to the gauge 43 which may be inconvenient if the operator is engaged in other tasks. In addition, the controller 26 may be used to pivot the swivel bracket 21 to preset positions stored in memory. One memory position may be achieved, for example, by holding the toggle switch 36 upwardly for one to five seconds. The other position may be achieved, for example, by holding the toggle switch 36 downwardly for one to five seconds. In this example, there are two memory presets for the swivel bracket 21 but there may be different numbers of memory presets in other examples.

Figure 4:
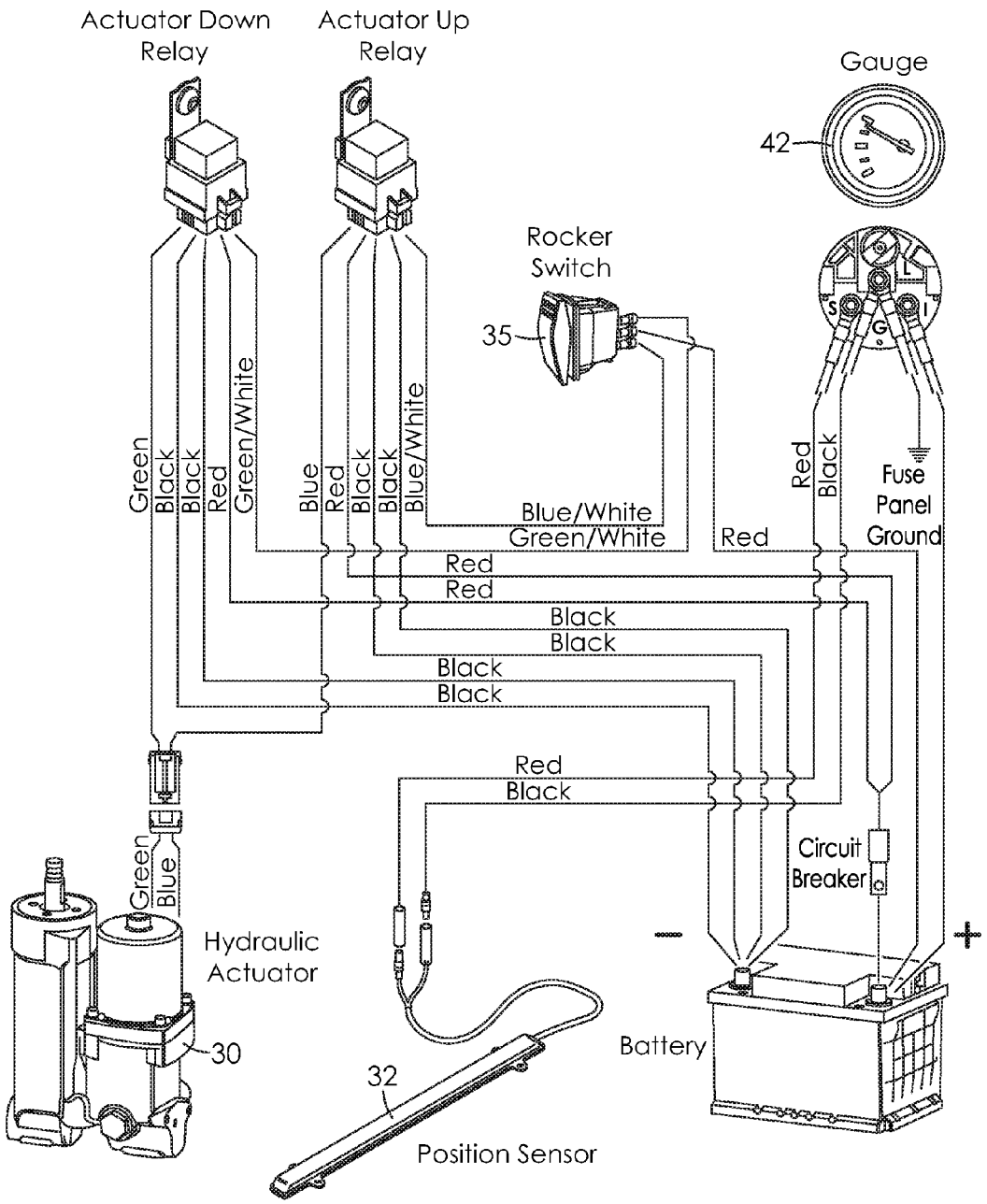
FIG. 4 is a schematic diagram of the connections between the jack plate, the gauge and the position sensor.
Figure 12A:
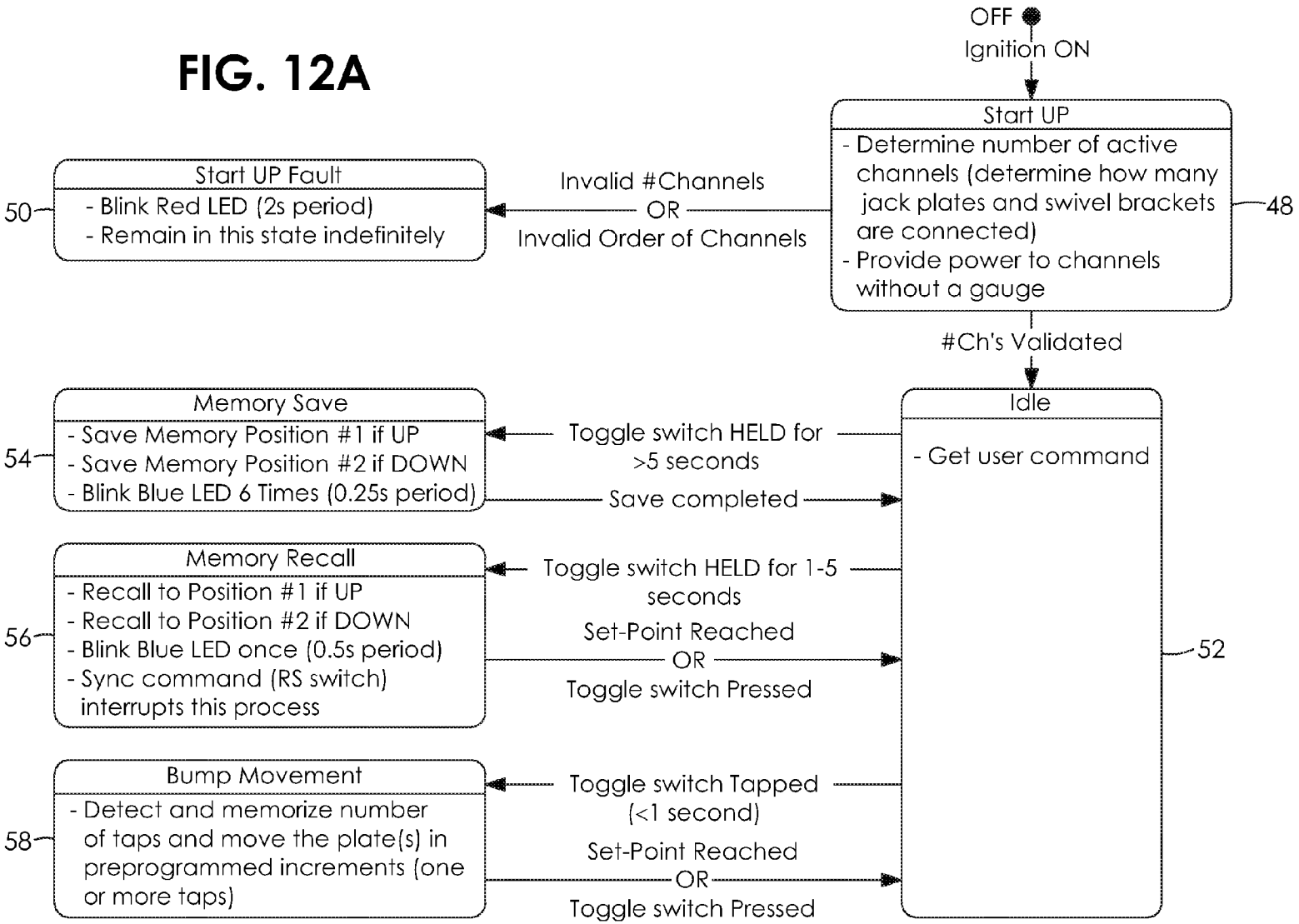
FIGS. 12A and 12B are flow charts showing the logic of moving the jack plates and pivoting the swivel brackets via a controller which receives input from the input device.
Figure 12B:
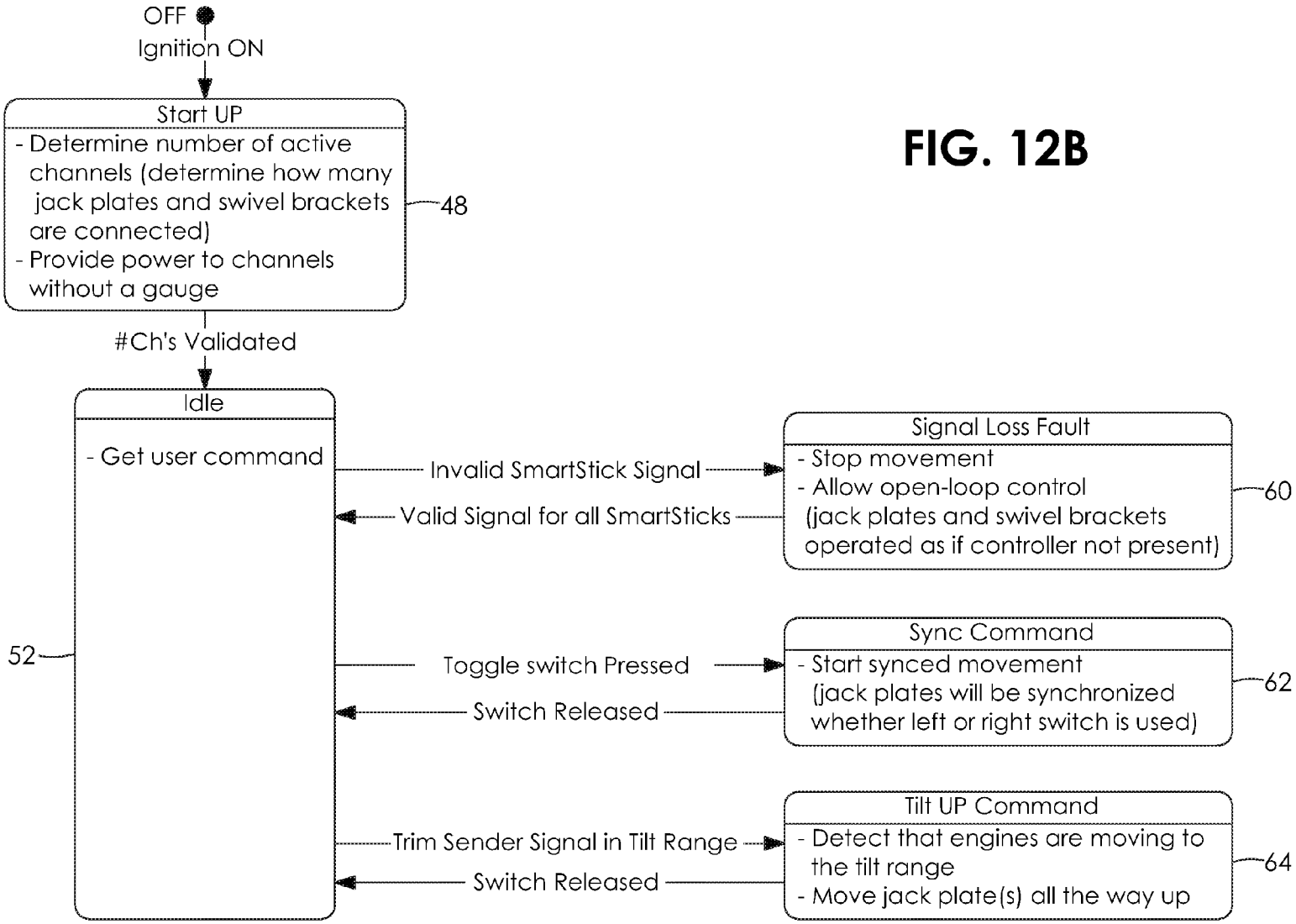

Operation of the controller 26 is shown in FIGS. 12A and 12B. System verification is performed at 48 to determine the number of active channels, i.e. the number of jack plates and swivel brackets connected to the controller 26. The controller 26 detects the number of jack plates and swivel brackets connected to it by providing power to the position sensors of the jack plates and detecting the presence of a return signal from each of the respective position sensors as shown in FIG. 4 for the position sensor 32 of the jack plate 20. However, if there is a gauge connected to the controller 26 as shown by gauge 42 in this example, then one of the position sensors, for example, the position sensor 32 of the jack plate 20, needs to be powered through the gauge 42. In this case, the controller 26 receives a parallel return signal, i.e. the S-line from the gauge 42 is connected to the controller 26. If an invalid number of channels or an invalid order of channels is detected, then a fault is indicated at 50 as shown in FIG. 12A via an indicator. The indicator may be a visual indicator, an auditory indicator or a vibratory indicator. In this example, the indicator is a red light-emitting diode 51, shown in FIG. 3, which blinks to indicate a fault. If no fault is detected, then the system enters an idle state at 52 as shown in FIG. 12A to await a command of the operator via the toggle switch 34 or 36 which are shown in FIG. 3.

Referring back to FIG. 12A, if the toggle switch 34 or 36 is held upwardly for more than five seconds in this example, then the current position of the jack plate 20 or the swivel bracket 21, respectively, is stored in memory as a first position as shown at 54. Conversely, if the toggle switch 34 or 36 is held downwardly for more than five seconds in this example, then the current position of the jack plate 20 or the swivel bracket 21, respectively, is stored in memory as a second position. An indicator signals to the operator that the positions have been stored in memory. The indicator may be a visual indicator, an auditory indicator or a vibratory indicator. In this example, the indicator is a blue light-emitting diode 53, shown in FIG. 3, which blinks six times to signal that the positions have been stored in memory.

If the toggle switch 34 or 36 is subsequently held upwardly for between one and five seconds in this example, then the jack plate 20 or the swivel bracket 21, respectively, moves to the stored first position as shown at 56. Similarly, if the toggle switch 34 or 36 is subsequently held downwardly for between one and five seconds in this example, then the jack plate 20 or the swivel bracket 21, respectively, moves to the stored second position. The operation is stopped once the jack plate 20 or the swivel bracket 21 moves to the stored first position or the stored second position. The blue light-emitting diode 53 then blinks once to signal that the jack plate 20 or the swivel bracket 21 has moved to the desired stored position. Alternatively, the operation of the jack plate 20 or the swivel bracket 21 may be interrupted by pushing the toggle switch 34 or 36 respectively.

If the toggle switch 34 or 36 is pushed or bumped upwardly or downwardly for less than one second, then the jack plate 20 or the swivel bracket 21, respectively, moves accordingly upwardly or downwardly an incremental amount for each time the toggle switch 34 or 36 is so pushed or bumped as shown at 58. As stated above, the number of times the toggle switch 34 or 36 is pushed or bumped is aggregated and the jack plate 20 or the swivel bracket 21, respectively, is moved the corresponding amount. The operation is stopped once the jack plate 20 or the swivel bracket 21 has moved the corresponding amount. Alternatively, the operation of the jack plate 20 or the swivel bracket 21 may be interrupted by pushing the toggle switch 34 or 36 respectively.

If an invalid input is detected, then movement of the jack plate 20 or the swivel bracket 21 is stopped as shown at 60 in FIG. 4B. Open-loop control of the jack plate 20 or the swivel bracket 21 is then allowed, i.e. the jack plate 20 or the swivel bracket 21 is operated as if the controller 26 is not present.

Figure 13:
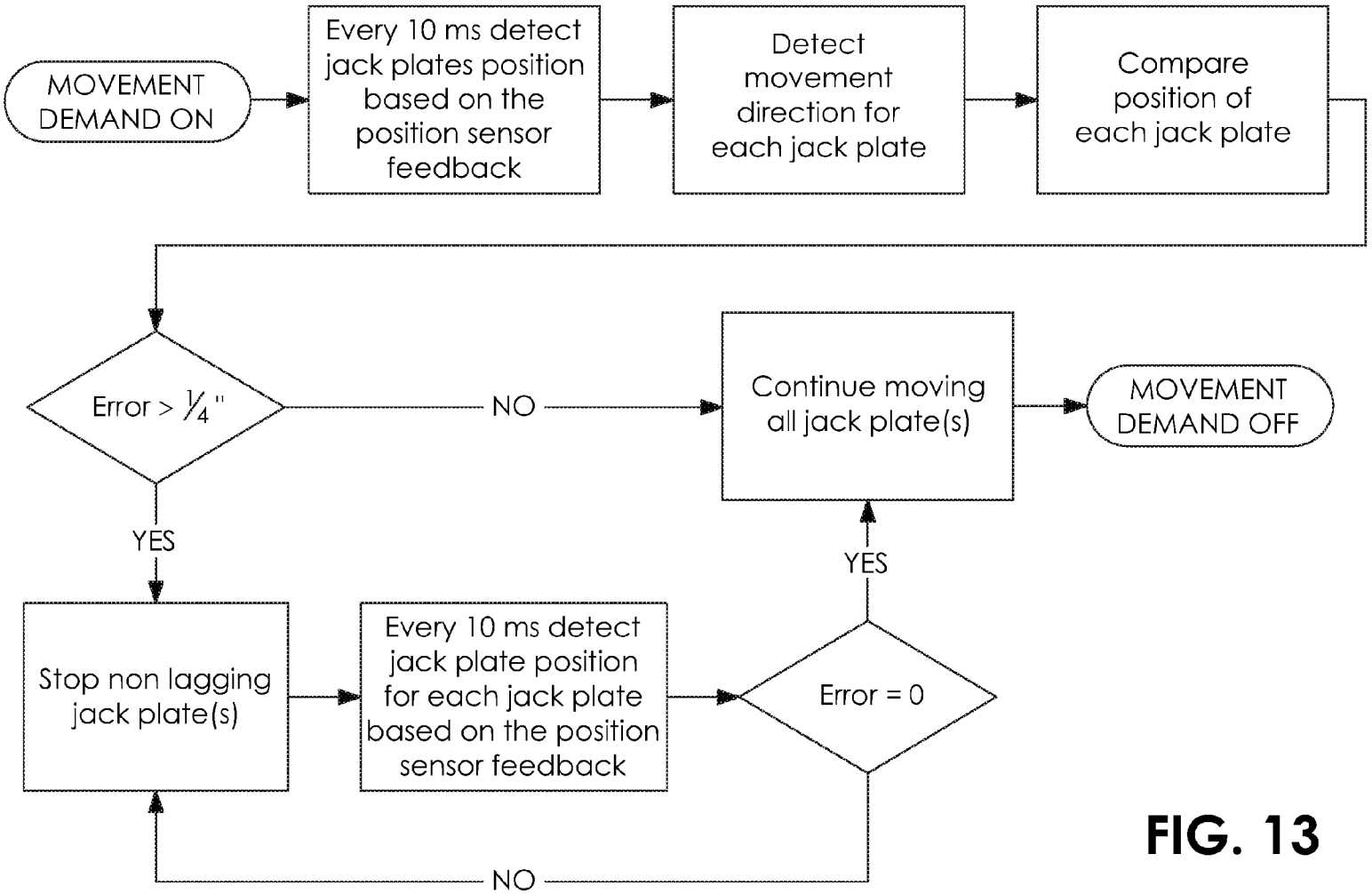
FIG. 13 is a flow chart showing the logic of synchronizing movement of the jack plates.

As shown at 62, operation of the toggle switch 34 causes open-loop movement of the outboard engines 12, 14 and 16 synchronously upwardly or downwardly until the toggle switch 34 is released. The controller 26 detects the connection of multiple jack plates and automatically attempts to synchronize the jack plates whether the jack plates are operating in the normal mode or in the smart mode. FIG. 13 is a flow chart showing the logic of synchronizing the jack plates. When the synchronization command is inputted via the toggle switch 34, the positions of the jack plates are detected every ten milliseconds in this example based on feedback from the respective position sensors. The direction of movement is detected for each jack plate and the position of each jack plate is compared. If the positions of the jack plates are within a distance of ¼ inch relative to each other in this example, then movement of all the jack plates is continued until a desired position of the jack plates is achieved. However, if any of the jack plates is positioned more than a distance of ¼ inch relative to each other in this example, then movement of the non-lagging jack plate(s) is stopped to allow the lagging jack plate(s) to catch up. The position of each jack plate is then detected every ten milliseconds in this example based on feedback from the respective position sensors. If the positions of the jack plates are aligned, then movement of the jack plates continues until a desired position of the jack plates is achieved. Otherwise, movement of the non-lagging jack plate(s) is once again stopped to allow the lagging jack plate(s) to catch up.

Figure 14:
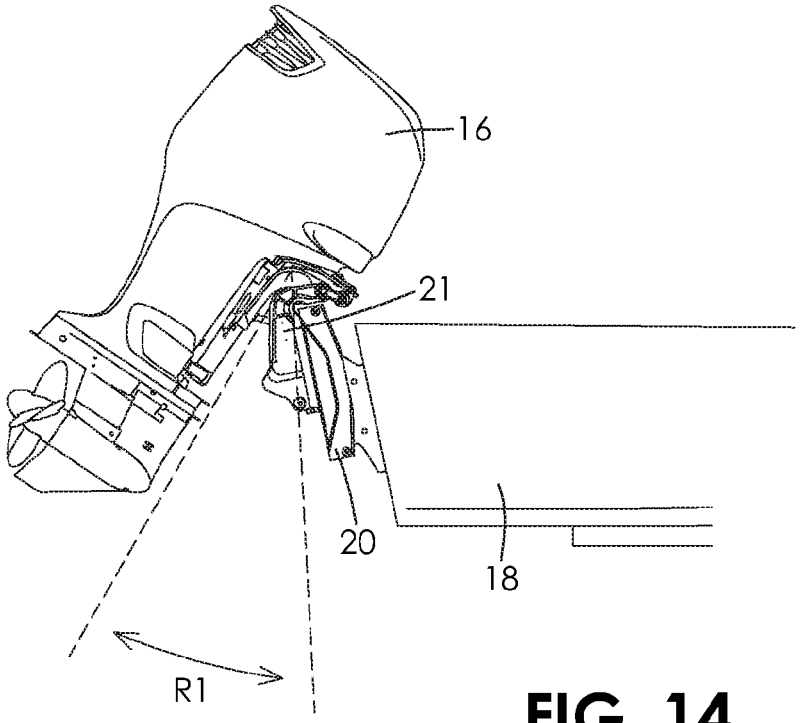
FIG. 14 is a side elevation view showing the propulsion unit of FIG. 2 in a fully trimmed position.
Figure 15:
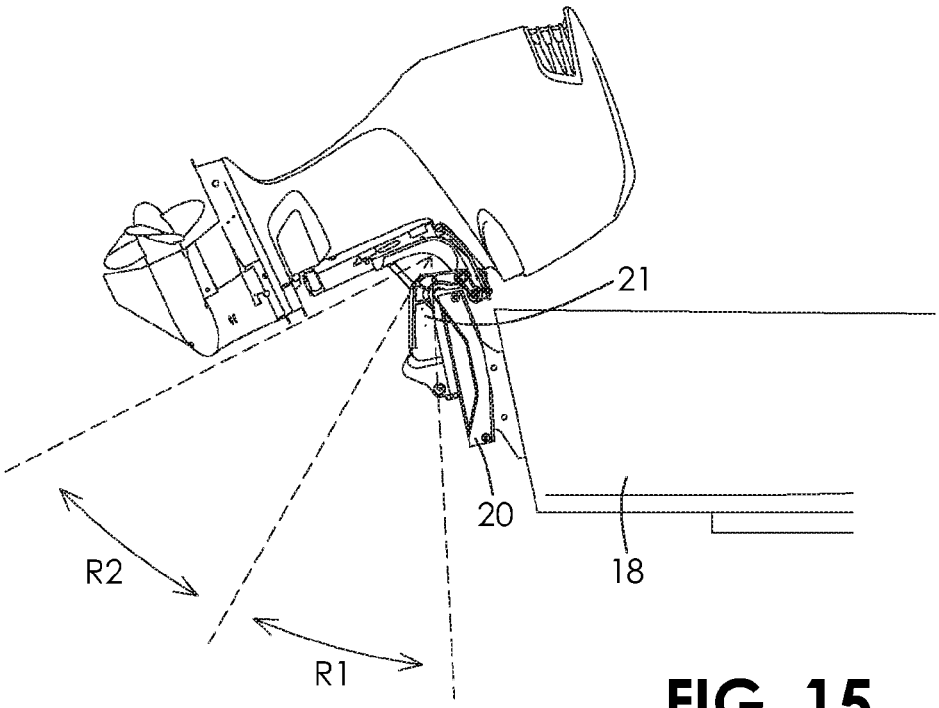
FIG. 15 is a side elevation view showing the propulsion unit of FIG. 2 in a fully tilted position.
Figure 16:
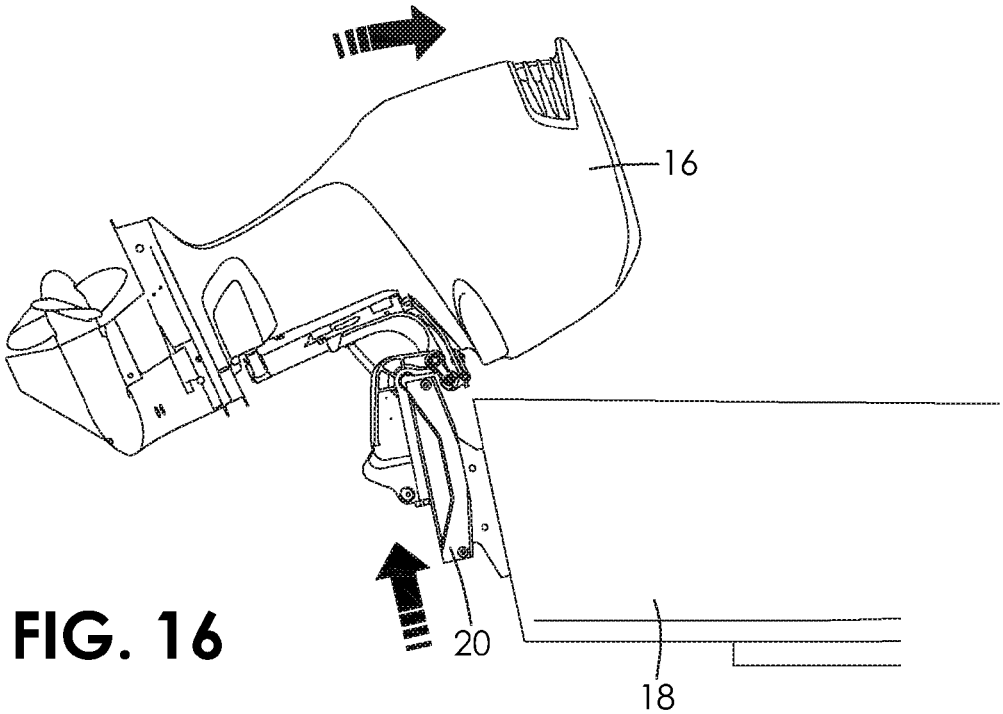
FIG. 16 is a side elevation view showing the jack plate fully raised and the propulsion unit of FIG. 2 fully tilted out of the water.
Figure 17:
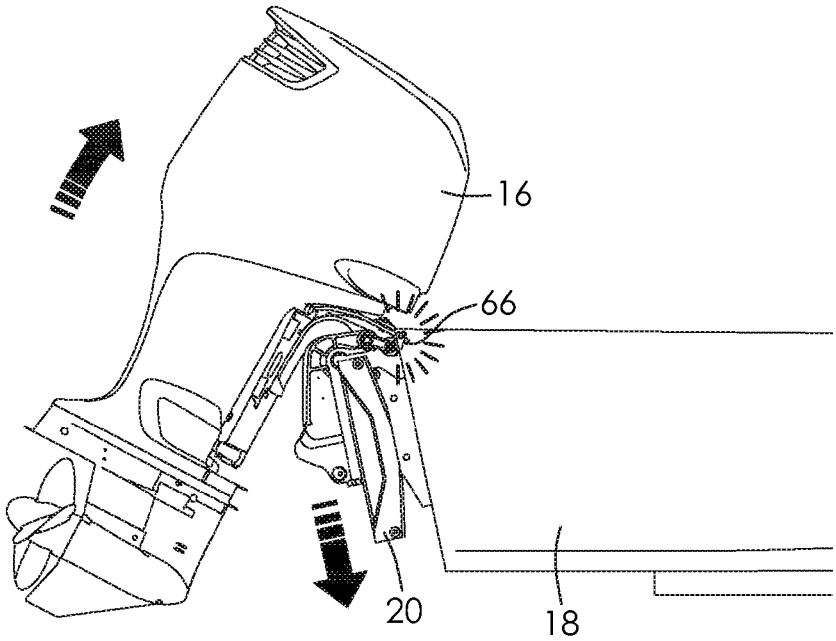
FIG. 17 is a side elevation view showing the jack plate fully lowered and a steering cylinder of the propulsion unit of FIG. 2 colliding with the transom of the marine vessel.

A trim position sensor may signal the controller 26 when the outboard engine 16 is in a proper trim position. Typically, the outboard engine 16 will be in a fully tucked under position as the marine vessel 10 starts to move. As the marine vessel 10 reaches plane, the outboard engine 16 is trimmed up to a desired trim position, which in this example is a fully trimmed position, within a trimming range $R_1$ as shown in FIG. 14. This trim position may be stored in the memory of the controller 26 for quick recall later as described above. When the outboard engine 16 is within a tilt range $R_2$ as shown in FIG. 15, the controller 26 detects a tilt up command from a trim sender and accordingly moves the jack plate 20 to a pre-programmed, "safe" vertical position which provides additional clearance to the transom 18 or the jack plate 20 as shown in FIG. 16. This restricts a steering cylinder 66 of the outboard engine 16 from colliding with the transom 18 or the jack plate 20 when the outboard engine 16 is fully tilted out of the water as shown in FIG. 17. The jack plate 20 is moved to the safe position if the controller 26 detects that the jack plate 20 is below the safe position when the outboard engine 16 is within the tilt range $R_2$. However, if the controller 26 detects that the jack plate 20 is above the safe position when the outboard engine 16 is within the tilt range $R_2$, then the controller 26 will not move the jack plate 20.

Figure 18:
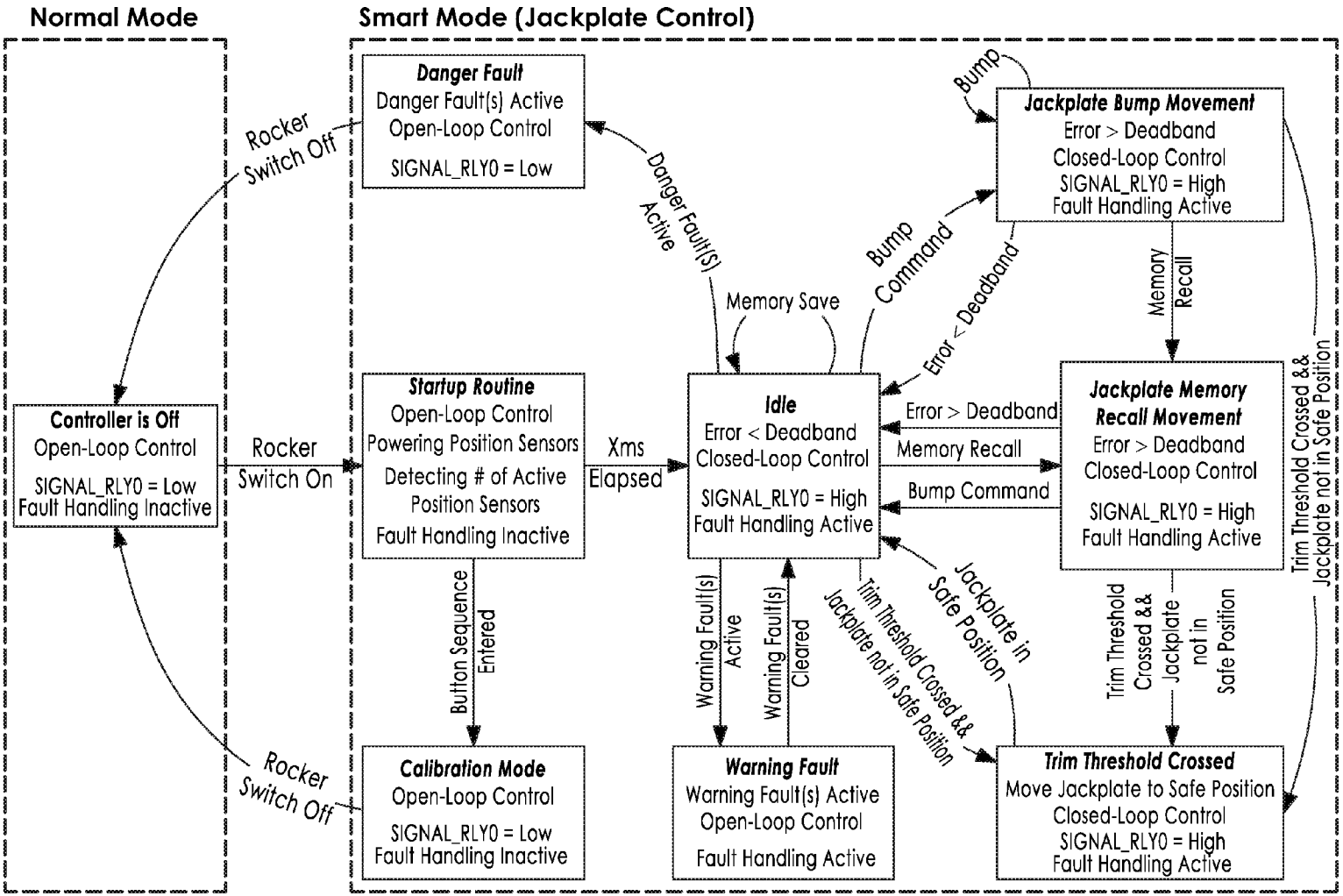
FIG. 18 is a schematic diagram showing the logic of a software algorithm which controls the jack plate in the normal and smart modes.

FIG. 18 shows software logic of how the jack plate 20 is controlled. In the normal mode, there is open-loop control of the jack plate 20. When the rocker switch 35 is switched on, the system enters the smart mode. During the start-up routine, the number of active position sensors is detected and power is provided to the position sensors. A calibration mode can be entered at this stage, for example, by pressing a button sequence. The calibration mode is exited by switching off the rocker switch 35 to return the system to the normal mode.

After a certain amount of time has elapsed, the system enters an idle state to await a command of the operator via the toggle switch 34. Control of the jack plate 20 is closed-loop at this stage. If a warning fault is detected, then there is open-loop control of the jack plate 20 for the duration that the warning fault is active. Once the warning fault is cleared, then the system returns to the idle state. If however a danger fault is detected, then there is open-loop control of the jack plate 20 and the rocker switch 35 is switched off to return the system to the normal mode.

When an operator inputs a bump command by quickly pushing or bumping the toggle switch 34 either upwardly or downwardly, the jack plate 20 moves accordingly upwardly or downwardly an incremental amount for each time the toggle switch 34 is so pushed or bumped. The operation is stopped once the jack plate 20 has moved the corresponding amount and the system returns to the idle state. A position of the jack plate 20 can be stored in memory when the system is in the idle state. The memory can be recalled by the system and the jack plate 20 moved to the stored position. The stored position can also be recalled during bump movement of the jack plate. 20 The memory recall operation can be interrupted by inputting a bump command, i.e. by pushing or bumping the toggle switch 34.

If at any time the system detects that a trim threshold has been crossed and the jack plate 20 is not in a vertical position which provides sufficient clearance to the transom 18, then the system will move the jack plate 20 to a pre-programmed safe vertical position.

Figure 19:
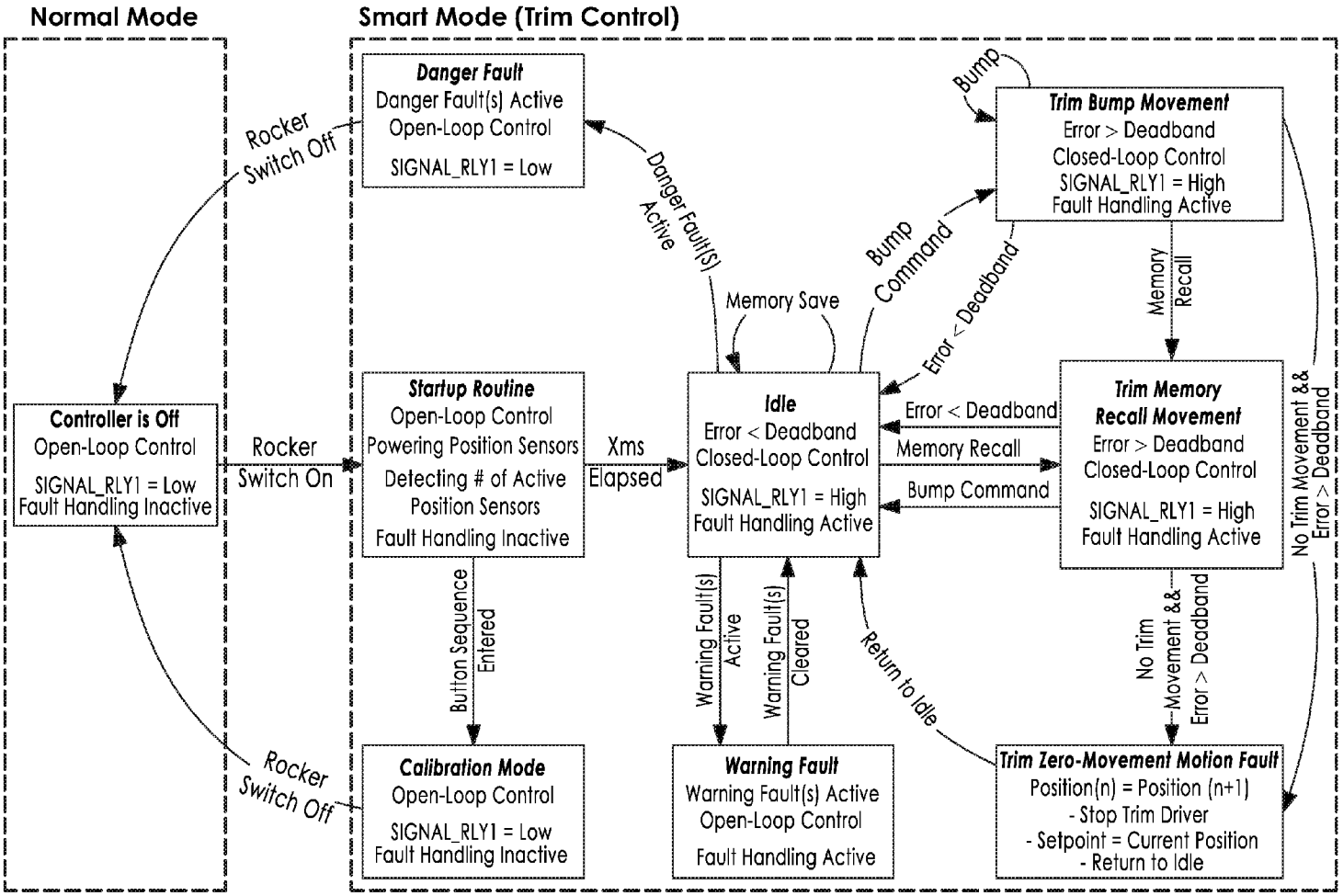
FIG. 19 is a schematic diagram showing the logic of a software algorithm which controls the swivel bracket in the normal and smart modes.

FIG. 19 shows software logic of how the swivel bracket 21 is controlled. Operation of the system during start-up, calibration and faults are substantially the same as that described above for the jack plate 20. However, an operator inputs a bump command by quickly pushing or bumping the toggle switch 36 upwardly or downwardly. This will pivot the swivel bracket 21 upwardly or downwardly an incremental amount for each time the toggle switch 36 is so pushed or bumped. The operation is stopped once the swivel bracket 21 has moved the corresponding amount and the system returns to the idle state.

A position of the swivel bracket 21 can be stored in memory when the system is in the idle state. The memory can be recalled by the system and the swivel bracket 21 moved to the stored position. The stored position can also be recalled during bump movement of the swivel bracket 21. The memory recall operation can be interrupted by inputting a bump command, i.e. by pushing or bumping the toggle switch 36. If however there is no trim movement during either the bump movement stage or the memory recall movement stage, then the trim drive is stopped and the current position of the swivel bracket 21 serves as the set point. The system then returns to the idle state.

Many advantages result from the structure of the present invention. For example, it allows an operator of a marine vessel to readily move an outboard engine upwardly or downwardly or to readily trim an outboard engine upwardly or downwardly the exact amount required without requiring the operator to measure distances or read a gauge. The distances are determined by the number of quick movements of the toggle switch 34 or 36 upwardly or downwardly. The system also accommodates simultaneous movement of a plurality of outboard engines.

It will be appreciated that many variations are possible within the scope of the invention described herein. For example, the input device 25 may be positioned in locations other than on the steering column 40 of the marine vessel 10. Other configurations of the controls are also possible. The system can be modified to suit vessels with a single outboard engine as well as vessels with more than three outboard engines. Furthermore, the incremental vertical movement of the outboard engines can be varied to amounts greater or less than ¼ inch. Similarly, the incremental pivot movement of the outboard engines can be varied to amounts greater or less than one degree.

It will be understood by a person skilled in the art that many of the details provided above are by way of example only, and are not intended to limit the scope of the invention which is to be determined with reference to the following claims.

What is claimed is:

1. An apparatus for adjusting a position of an outboard propulsion unit of a marine vessel, the apparatus comprising:

a jack plate having a mount for the outboard propulsion unit, the jack plate being mountable on a transom of the marine vessel, the jack plate having a jack plate actuator capable of raising the propulsion unit to a raised position and lowering the propulsion unit to a lowered position; and a control system operatively connected to the jack plate actuator for controlling movement between the raised position and the lowered position, the control system including a first manual control which incrementally moves the jack plate an incremental amount each time the first manual control is actuated, the control system including a memory which stores the number of times the first manual control has been actuated and moves the jack plate a plurality of incremental amounts equivalent to the number of times the first manual control has been actuated.

2. The apparatus as claimed in claim 1, wherein the apparatus comprises a plurality of jack plates, each said jack plate having a mount for a corresponding one of a plurality of outboard propulsion units, and wherein the first manual control causes the jack plates to move upwardly or downwardly synchronously, whereby a plurality of said propulsion units move the same amount when the first manual control is actuated.

3. The apparatus as claimed in claim 1, further including a swivel bracket having a mount for the outboard propulsion unit, the swivel bracket being connected to the jack plate, the swivel bracket having a swivel bracket actuator capable of pivoting the propulsion unit upwardly to a raised trim position and pivoting the propulsion unit downwardly to a lowered trim position.

4. The apparatus as claimed in claim 3, wherein the control system includes a second manual control which incrementally pivots the swivel bracket an incremental amount each time the second manual control is actuated and wherein the memory of the control system stores the number of times the second manual control has been actuated and pivots the swivel bracket a plurality of incremental amounts equivalent to the number of times the second manual control has been actuated.

5. The apparatus as claimed in claim 4, wherein the apparatus comprises a plurality of swivel brackets, each said swivel bracket having a mount for a corresponding one of a plurality of outboard propulsion units, and wherein the second manual control causes the swivel brackets to move upwardly or downwardly synchronously, whereby a plurality of said propulsion units pivot the same amount when the second manual control is actuated.

* * * * *